US006543317B1

(12) United States Patent
Rinner et al.

(10) Patent No.: US 6,543,317 B1
(45) Date of Patent: Apr. 8, 2003

(54) SCREW HOLDER AND TORQUING TOOL

(75) Inventors: James A. Rinner, Racine, WI (US); Mary E. Uhrich, Milford, MA (US)

(73) Assignee: Beere Precision Medical Instruments, Inc., Kenosha, WI (US)

( * ) Notice: Subject to any disclaimer, the term of this patent is extended or adjusted under 35 U.S.C. 154(b) by 0 days.

(21) Appl. No.: 10/017,964

(22) Filed: Dec. 18, 2001

(51) Int. Cl.[7] ..... B25B 13/06
(52) U.S. Cl. ..... 81/125; 81/452; 81/176.2
(58) Field of Search ..... 81/125, 438, 452, 81/13, 176.2

(56) References Cited

U.S. PATENT DOCUMENTS

| | | | | | |
|---|---|---|---|---|---|
| 1,698,521 | A | * | 1/1929 | Wood | 81/452 |
| 1,712,196 | A | * | 5/1929 | Burger et al. | 81/452 |
| 2,247,500 | A | * | 7/1941 | Hutchison, Jr. | 81/125 |
| 2,304,271 | A | * | 12/1942 | Merriman et al. | 81/125 |
| 2,566,673 | A | * | 9/1951 | Nygaard | 81/452 |
| 2,611,289 | A | * | 9/1952 | Frank | 81/125 |
| 2,704,954 | A | * | 3/1955 | Martorella | 81/112 |
| 2,798,394 | A | * | 7/1957 | Hubbard | 81/125 |
| 2,805,594 | A | * | 9/1957 | Fogel | 81/125 |
| 3,056,441 | A | * | 10/1962 | Helms | 81/429 |
| 3,162,072 | A | * | 12/1964 | Stewart | 81/55 |
| 3,379,231 | A | * | 4/1968 | Gallo, Sr. | 81/455 |
| 3,901,298 | A | * | 8/1975 | Eby | 81/455 |
| 4,644,831 | A | * | 2/1987 | Yang | 81/125 |
| 4,744,273 | A | * | 5/1988 | Bartok, Jr. | 81/453 |
| 4,976,174 | A | * | 12/1990 | Walsh | 81/125 |
| 5,605,080 | A | * | 2/1997 | Pfefferle et al. | 81/456 |
| 6,299,616 | B1 | * | 10/2001 | Beger | 606/86 |

FOREIGN PATENT DOCUMENTS

| | | | | |
|---|---|---|---|---|
| JP | 01199774 | A | * 8/1989 | B25B/23/10 |

* cited by examiner

*Primary Examiner*—Joseph J. Hail, III
*Assistant Examiner*—David B. Thomas
(74) *Attorney, Agent, or Firm*—Arthur J. Hansmann

(57) ABSTRACT

A screw holder and torquing tool having a one-piece body with a cavity for receiving a screw in a sturdy and stable condition. The screw can be applied in stabilizing bone, and the tool can apply sufficient torque though it is of a relatively small overall size. Tangs or fingers are flexible on the tool and they flex toward and away from the cavity and they hold the screw in the tool until the screw is embedded into bone or other host object.

6 Claims, 1 Drawing Sheet

SCREW HOLDER AND TORQUING TOOL

This invention relates to a screw holder and torquing, and more particularly, it relates to a torquing tool which can maneuver a screw or the like which has an axially rotatable drive portion and a shank end extending to both axial ends of the drive portion.

BACKGROUND OF THE INVENTION

The prior art is aware of various tools such as screw drivers, screw holders, adapters, attachments, devices, and the like for applying screws and like members to host objects. Such known tools are capable of holding a screw and then torquing it in applying the screw to the host object. The arrangement for holding the screw can include flexible fingers or the like which hold the screw until it is imbedded in the host object. Those prior art tools are commonly in two parts, one of which holds the screw and another separate part which torques the screw.

The present invention provides a tool which holds the screw or like work piece and also torques that work piece for applying it to the host object. This object is accomplished by trapping the screw for holding it securely so it can be accurately directed to the host object and the screw is then forcefully torqued into the host object. The tool is of a single body having two portions for those two respective functions, so it is easily and accurately be maneuvered in the application of those two functions.

The screw or the like useful in this invention is intended to be applied in surgical procedures. Thus the need for accuracy is crucial. The provision of a one-piece tool meets the requirements for the precision work that is in demand.

It is an object of this invention to provide a tool that serves the dual functions of holding the work piece and applying torque to that work piece. This is particularly useful in a work piece having two opposite ends with threads on each of the ends. Also, this tool is arranged for being both rotationally driven and for transmitting the torque for embedding the screw into the host object.

The tool of this invention is capable of applying a forceful torque, such as one sufficient to drive a screw into sturdy bone, during surgical procedures.

DETAILED DESCRIPTION OF THE PREFERRED EMBODIMENT

Figures 1, 2, 3, 4, 5, 6, 7, 8, 9, 10:
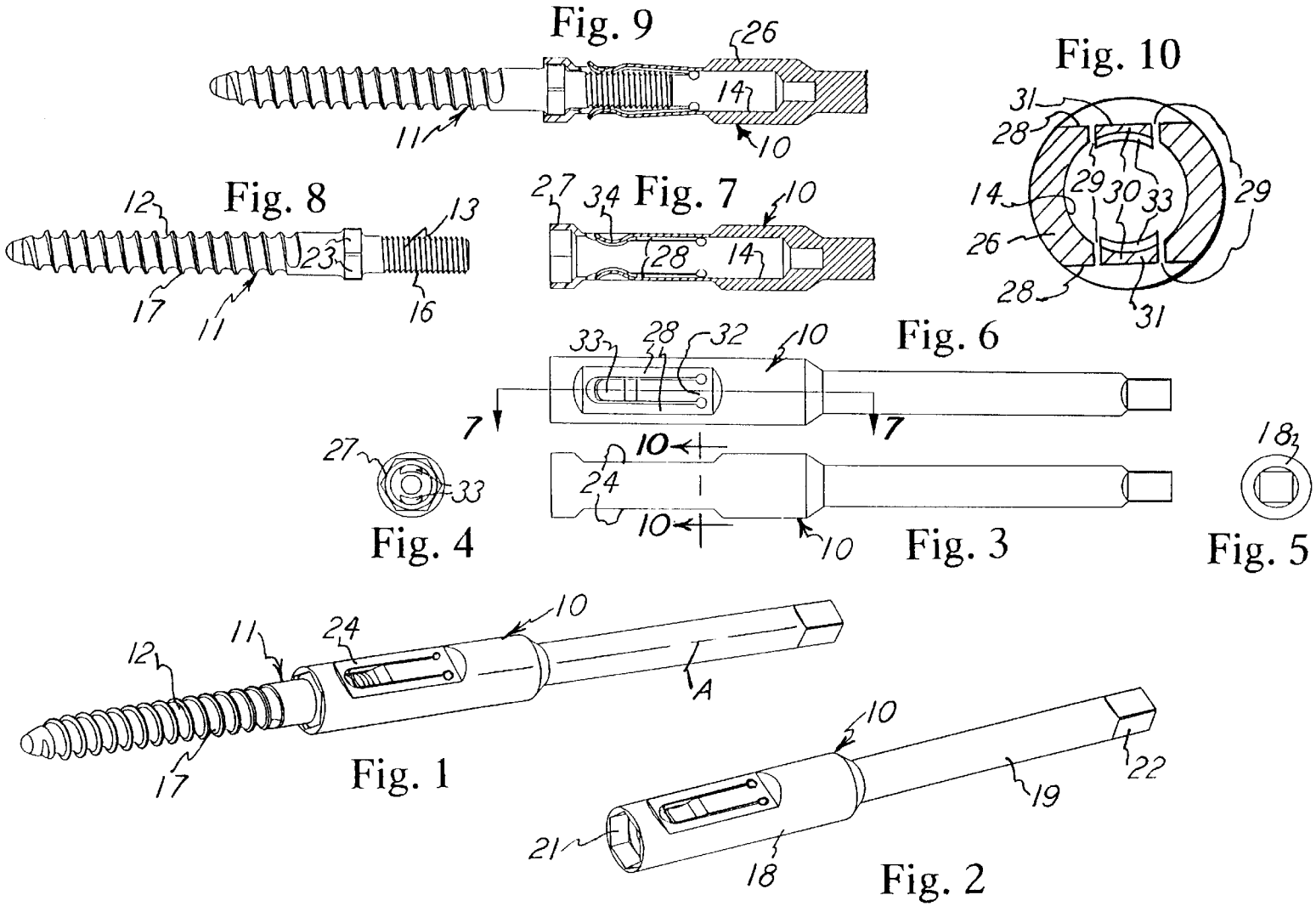
FIG. 1 is a perspective view of a preferred embodiment of the tool of this invention, with a screw shown therein.
FIG. 2 is a perspective view similar to FIG. 1 but without the screw.
FIG. 3 is a side elevational view of the tool of FIG. 1.
FIGS. 4 and 5 are respectively left hand and right hand views of FIG. 3.
FIG. 6 is a top plan view of FIG. 3.
FIG. 7 is a sectional view taken on a plane designated by the line 7—7 of FIG. 6.
FIG. 8 is a side elevational view of the screw shown in FIG. 1.
FIG. 9 is a sectional view similar to FIG. 7 but with the screw included therein.
FIG. 10 is an enlarged sectional view taken on the plane designated by the line 10—10 of FIG. 3.

The tool or adapter shown herein has a body 10 which is elongated and extends along a central longitudinal axis designated A. The body is made of sturdy material capable of transmitting rotation torques about axis A and of sufficient force to drive screws, such as screw 11, into host objects, such as bone, when used in surgery. Screw 11 is elongated and extends coaxially with axis A and has a first threaded end 12 and is shown to have a shank portion 13 disposed within a cylindrical cavity 14 in the body 10. The shank 13 may have screw threads, such as the shown threads 16, and the extending screw end 12 may have screw threads 17. Threads 16 and 17 are shown to be of thread profiles different from each other, that is, they are shown to be relatively fine at 16 and relatively coarse at 17. End 12 is arranged to be embedded into a host object, such as bone, and threads 16 can receive an unshown nut or the like, as such, the screw is useful in anchoring a rod in spine fixation. Also, screw end 12 is shown to be longer than screw end 13.

Body 10 has hollow tubular portions 18 and 19, with those two portions being integral and of one elongated piece within the structure of the body 10, and they are availabe for cannulation, if desired. The end of the portion 18 has a flat sided exposed socket 21 and the end of the portion 19 is flat sided at 22. Thus, a driver of any conventional rotational drive function, either manual or powered, but which is and need not be shown herein, engages the end 22 as a rotation drive input end to rotate the tool about the axis A.

The driven member, which in this disclosure is shown as the screw 11, has flat sides 23 which present a screw head to be disposed in the socket 21 to mate therewith and thus be in rotation drive relationship with the rotating body 10. As shown, the drive to what is the work piece 11 is through the flat and multi-sided surfaces, such as the hexagons shown, mating therebetween.

Thus, rotation drive from the tool 10 is transmitted to the work piece 11 to embed the end 12 into a host object, and the one-piece body 10 is rigid and sufficiently sturdy to accomplish that function.

Another feature of this invention is the holding the work piece 11 in the body 10 until the work piece is embedded as mentioned. That is, the work piece, which is shown to be the screw 11, is restrained against movement relative to the body 10 and along the axis A.

In the cavity portion 18, there are two diametrically oppositely disposed cutouts 24 extending into the wall 26 which forms the cavity 14. That is, the wall 26 is shown to be circular and it defines the portion 18 and is of a thickness to render the tool capable of transmitting the torques required of this tool to embed the work piece 11, as mentioned. Sectioned views in FIGS. 7, 9, and 10 show the thickness of the wall 26. Except for the two cutouts 24 and the output end 27 which presents the flat sides 21, the wall 26 extends throughout the portion 18. The end 27, as shown, is reduced in its wall thickness compared to the wall thickness 26, but it is disposed at the full outer diameter of the location of the wall 26 and is therefore capable of transmitting the desired high torques. Of course, a smaller flat sided opening at 21, to accommodate a smaller screw head 23, would present a thicker wall thickness at 21, and that could be the full thickness of the wall 26, for instance.

The two cutouts at 24 leave two diametrically disposed flats 28 extending fragmentarily on the body portion 18. in actually, The flats 28 present walls adjacent thereto and which, as shown in FIG. 10, are irregular in their cross sectional size in their respective extents around the body portion 18, as shown in FIG. 10. That arrangement leaves the wall thickness 26 extending for the majority of the circumference of the body portion 18 and thus optimum torque can be transmitted by the tool and that torque can be in the magnitude of 150 in-lbs though the tool itself is small so it is useful in surgery where the tool is positioned at a patient's body without interfering with the surgeon's view of the work site.

Two longitudinal slits 29 are in the body 18 at each cutout area 24, and they form an opening 30 therebetween, and thus two fingers, tangs, or strips 31 are formed at each cutout 24. One end 32 of each tang 31 is integral with the remainder of the body portion 18 while the other end 33 of each tang 31 is free to move radially relative to the axis A. In the unstressed condition of the tangs 31, the free end 33 is shaped to extend radially inwardly and be disposed in the cavity 14. As such, the tangs contact the shank of the screw 11, as seen in FIG. 9, to restrain the screw in the axial direction. The holding and release thereof is automatic, and the screw need only be inserted into the cavity 14 and the concave curves at 34 on the tang ends 33 permit the screw to slide into and out of the cavity 14. Likewise, the screw is automatically released from the tool after there is axial force on the screw in the direction away from the tool, and that force may be applied by simply withdrawing the tool 10 away from the then embedded screw 11. The body may be made of steel material to be sturdy and have the tangs 31 repeatedly flexible and biased inwardly in its free body position.

Throughout the handling of the screw as mentioned, the screw end or shank 13 is in snug contact with the wall defining the cavity 14, as seen in FIG. 9, and thus the screw is stable with the tool. The two diametrically disposed tangs 31 hold the screw on its opposite circumferential sides to thereby hold the screw steady and secure until it is intentionally released. The extent of the tangs 31 around the circumference of the body portion 18 is less than half that circumference, thus, with the totality of the thicker wall 26 intervening between the tangs 31, there is ample wall body for transmitting sufficient torque to the screw.

In a different arrangement, instead of two tangs there could be only one which extends into the cavity to hold the screw, especially where the screw shank 13 is snug in the cavity 14. Also the tang 31 could be formed on the body portion 18 without the cutout 24, providing there is provision for sufficient flexing of the tang or tangs on the body 18 and radially of the axis A.

What is claimed is:

1. A screw holder and torquing tool with a screw, comprising:

an elongated screw having a length with two threaded ends and a rotation drive surface intermediate said ends, a one-piece cylindrical tool having a longitudinal axis and a length extending along said axis and about which said tool is rotatable and having two terminal ends spaced apart along said axis and having a longitudinally axially extending hollow interior intermediate along said tool length, a first one of said threaded ends being disposed in said hollow interior and a second one of said threaded ends extending beyond said tool, both said terminal ends of said tool having rotation drive configurations of a flat-sided shape for respectively receiving and transmitting rotation forces relative to said axis of said tool and with said screw rotation drive surface being in contact with a first one of said tool ends for rotating said screw with said tool, said tool having two strips diametrically opposed relative to said axis and extending axially along said tool and with each of said strips having two terminal ends spaced apart axially of said tool and with respective first ones of said strip ends being integral on said tool and flexible thereon and with respective second ones of said strip ends being free and radially movable toward and away relative to said axis upon flexing at said first ends, and said second one of said strip ends being offset radially inwardly toward said axis and from the remainder of the respective one of said strips for being disposed in said hollow interior and in diametrically opposed contact with said first one of said threaded ends of said screw for frictionally releasably restraining said screw axially of said tool.

2. The screw holder and torquing tool with a screw, as claimed in claim 1, wherein:

the offset of said second one of said strip ends is in a concave shape as viewed from the exterior of said tool to thereby present a curved surface in contact with said first one of said threaded ends of said screw.

3. A screw holder and torquing tool with a screw, comprising:

an elongated screw having a length with two threaded ends and a rotation drive surface intermediate said ends, an elongated tool having a longitudinal axis about which said tool is rotatable and having two terminal ends spaced apart along said axis and having a wall with a first thickness extending in a direction away from said axis and with said wall defining a longitudinally axially extending hollow interior for receiving said screw, one of said screw threaded ends being disposed in said hollow interior, both said terminal ends of said tool having rotation drive configurations of a flat-sided shape for respectively receiving and transmitting rotation forces relative to said axis of said tool and with said screw rotation drive surface being in rotation driven contact with one of said drive configurations of said tool, a portion of said wall being of a thickness less than said first thickness and extending in an axially longitudinal direction on said tool, said portion including a strip extending in the axially longitudinal direction and having two axially spaced apart strip ends with a first one of said strip ends being integral with the remainder of said tool and flexible thereon and a second one of said strip ends being movable toward and away relative to said axis and relative to the remainder of said tool, and said second one of said strip ends being disposed in said hollow interior in contact with said one of said screw threaded ends for releasably holding said screw in said tool.

4. The screw holder and torquing tool as claimed in claim 3, including:

said tool having two strips diametrically opposed relative to said axis and extending axially along said tool and with each of said strips having two terminal ends spaced apart axially therealong and with said first one of said strip ends being integral on said tool and flexible thereon and with the second one of said strip ends being free and radially movable toward and away relative to said axis upon flexing at said first end, and said second one of said strip ends being offset radially inward toward said axis and from the remainder of the respective one of said strips for being disposed in said hollow interior and in diametrically opposed contact with said first one of said ends of said screw for releasably restraining the screw axially of said tool.

5. The screw holder and torquing tool with a screw, as claimed in claim 3, including:

said wall having a circumferential exterior, and said wall portion being presented by having a depression in said wall circumferential exterior at said strip for presenting said strip with a thickness radial of said axis and less than that of the remainder of said wall.

6. The screw holder and torquing tool with a screw, as claimed in claim 3, wherein:

said second one of said strip ends is offset radially inward toward said axis and from the remainder of said strip for being disposed in said hollow interior and in contact with said one of said screw threaded ends for releasably restraining said screw axially of said tool, and the offset of said strip end is in a concave shape as viewed from the exterior of said tool to thereby present a curved surface in contact with said first one of said threaded ends of said screw.

* * * * *

UNITED STATES PATENT AND TRADEMARK OFFICE

CERTIFICATE OF CORRECTION

PATENT NO. : 6,543,317 B1 
DATED : April 8, 2003
INVENTOR(S) : James A. Rinner and Mary E. Uhrich It is certified that error appears in the above-identified patent and that said Letters Patent is hereby corrected as shown below:

Title page,
Item [56], U.S. PATENT DOCUMENTS, add the following:

| | | | |
|---|---|---|---|
| -- 1,426,320 | 8/1922 | Reid | |
| 1,450,203 | 4/1923 | Brown | |
| 1,549,413 | 8/1925 | Greet | |
| 1,782,565 | 11/1930 | Dohnal | |
| 2,028,546 | 1/1936 | John | 145/52 |
| 2,954,809 | 10/1960 | Loewy | |
| 3,245,446 | 4/1966 | Morifuji | |
| 3,351,111 | 11/1967 | Biddle | 145/52 |
| 4,363,250 | 12/1982 | Suga | 81/455 |
| 4,526,072 | 7/1985 | Manhoff | 81/452 |
| 4,581,963 | 4/1986 | Kim | 81/452 |
| 4,719,828 | 1/1988 | Corsetti | 81/451 |
| 4,763,548 | 8/1988 | Leibinger | 81/453 |
| 4,787,278 | 11/1988 | Bononi | 81/438 |
| 5,129,292 | 7/1992 | Albert | 81/452 |
| 5,649,931 | 7/1997 | Bryant | 606/104 |
| 5,667,513 | 9/1997 | Torrie | 606/104 |
| 6,189,422 | 2/2001 | Stihl | 81/452 -- |

Signed and Sealed this

Thirteenth Day of May, 2003

JAMES E. ROGAN
*Director of the United States Patent and Trademark Office*